US008664551B2

(12) United States Patent
Nakajima et al.

(10) Patent No.: US 8,664,551 B2
(45) Date of Patent: Mar. 4, 2014

(54) OPERATING DEVICE

(75) Inventors: Hirokatsu Nakajima, Yokkaichi (JP); Satoru Chaen, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 13/641,983

(22) PCT Filed: Feb. 22, 2011

(86) PCT No.: PCT/JP2011/000970
§ 371 (c)(1),
(2), (4) Date: Oct. 18, 2012

(87) PCT Pub. No.: WO2011/145241
PCT Pub. Date: Nov. 24, 2011

(65) Prior Publication Data

US 2013/0037392 A1 Feb. 14, 2013

(30) Foreign Application Priority Data

May 20, 2010 (JP) ..... 2010-116384

(51) Int. Cl.
*H01H 3/00* (2006.01)

(52) U.S. Cl.
USPC ..... 200/18

(58) Field of Classification Search
None
See application file for complete search history.

(56) References Cited

U.S. PATENT DOCUMENTS

| | | | | |
|---|---|---|---|---|
| 2,759,371 | A * | 8/1956 | White | 74/567 |
| 3,184,557 | A * | 5/1965 | Clarcy | 200/4 |
| 3,612,789 | A * | 10/1971 | Marquis et al. | 200/47 |
| 8,164,009 | B2 | 4/2012 | Kagami et al. | |

FOREIGN PATENT DOCUMENTS

| | | |
|---|---|---|
| JP | 2006-318962 | 11/2006 |
| JP | 2007-080778 | 3/2007 |
| JP | 2008-309954 | 12/2008 |
| JP | 2009-135069 | 6/2009 |

OTHER PUBLICATIONS

International Search Report, mail date is May 17, 2011.

* cited by examiner

*Primary Examiner* — Edwin A. Leon
(74) *Attorney, Agent, or Firm* — Greenblum & Bernstein P.L.C.

(57) ABSTRACT

An operating device provides for mutually independent rotation for two rotation operating knobs. First and second rotation operating knobs rotating centered on a rotation axis are provided as well as a holding member including a rotation operating knob holder holding the rotation operating knobs so as to be capable of independent rotation. The rotation operating knob holder includes a first and second support surfaces having substantially circular tubular shapes centered on the rotation axis. The first rotation operating knob includes first switch operators causing a first switch element to output a signal and a first sliding surface having a substantially circular tubular shape capable of sliding over the first support surface. The second rotation operating knob includes second switch operators causing a second switch element to output a signal and a second sliding surface having a substantially circular tubular shape capable of sliding over the second support surface.

14 Claims, 5 Drawing Sheets

OPERATING DEVICE

FIELD OF THE INVENTION

The present invention relates to an operating device having a rotation operating knob which is rotated.

BACKGROUND OF THE INVENTION

Conventionally, an operating device including a rotation operating knob which is rotated has been provided in an instrument panel or the like in an automobile. When the rotation operating knob is rotated, the operated object, such as temperature or amount of air flow for an air conditioner, is operated.

For example, Related Art 1 discloses an operating device in which two rotation operating knobs are positioned in a line to left and right on a panel. Specifically, in addition to the two rotation operating knobs, the operating device includes a circuit board, two holding members, and a switch element. The circuit board is positioned on a rear side of the panel. The two rotation operating knobs are provided to a left and right position, respectively, on the circuit board. The two holding members hold each of the rotation operating knobs. The rotation operating knobs are capable of rotation around mutually parallel rotation axes. The switch element detects the rotation of each of the rotation operating knobs.

In the conventional operating device, the two rotation operating knobs are aligned in positions separated from each other. Therefore, installation space markedly increases. The required surface area of the circuit board also increases. Moreover, each of the rotation operating knobs is individually held by a respective holding member. Therefore, the number of components in the entire operating device increases. This increases the weight of the operating device and magnifies time and effort for installation.

RELATED ART

Patent Literature

Related Art 1: Japanese Patent Laid-open Publication No. 2008-309954

SUMMARY OF THE INVENTION

An object of the present invention is to provide an operating device capable of mutually independent rotation for two rotation operating knobs, without incurring a major increase in space required or in number of components.

In order to achieve this object, the operating device of the present invention includes a first rotation operating knob which is rotated so as to rotate centered on a rotation axis extending in a front-back direction; a second rotation operating knob which is positioned on an exterior side in a rotation diameter direction of the first rotation operating knob and which is rotated so as to rotate centered on the rotation axis shared with the rotation axis of the first rotation operating knob; a holding member which is interposed between the first rotation operating knob and the second rotation operating knob and which includes a tubular rotation operating knob holder holding the first rotation operating knob and the second rotation operating knob such that both are capable of mutually independent rotation; a first switch element which outputs a signal corresponding to a rotation amount of the first rotation operating knob; and a second switch element which outputs a signal corresponding to a rotation amount of the second rotation operating knob. The rotation operating knob holder includes an inner circumferential surface including a first support surface having a substantially circular tubular shape centered on the rotation axis and an outer circumferential surface including a second support surface having a diameter larger than the first support surface and having a substantially circular tubular shape centered on the rotation axis. The first rotation operating knob includes first switch operators provided at a plurality of positions aligned in a rotation circumference direction thereof and causing the first switch element to output a first detection signal each time one of the first switch operators passes a position opposite the first switch element and an outer circumferential surface including a first sliding surface having a substantially circular tubular shape and capable of sliding over the first support surface in the rotation circumference direction. The second rotation operating knob includes second switch operators provided at a plurality of positions aligned in the rotation circumference direction thereof and causing the second switch element to output a second detection signal each time one of the second switch operators passes a position opposite the second switch element and an inner circumferential surface including a second sliding surface having a substantially circular tubular shape and capable of sliding over the second support surface in the rotation circumference direction.

With this operating device, mutually independent rotation of two rotation operating knobs is enabled without incurring a major increase in space required or in the number of components.

MODE FOR CARRYING OUT THE INVENTION

A preferred embodiment of the present invention is described with reference to the drawings.

Figure 1:
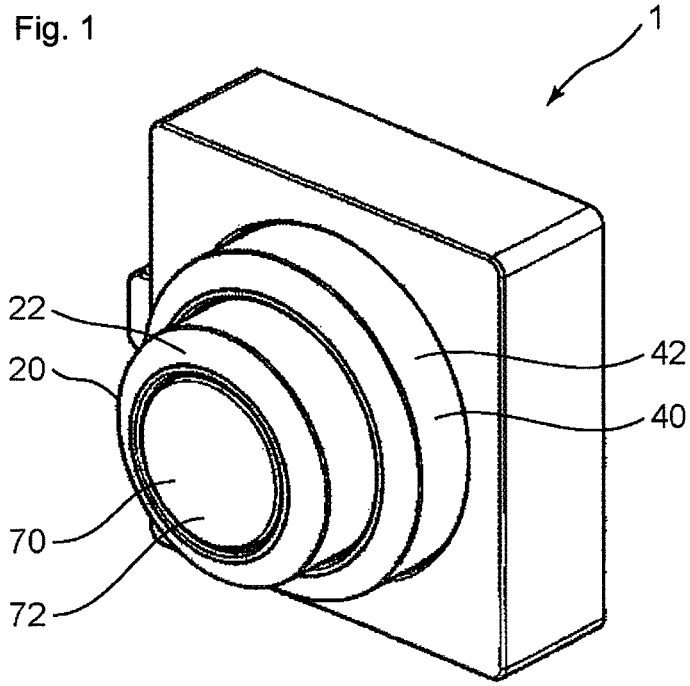
FIG. 1 is a schematic perspective view illustrating a state in which an operating device according to an embodiment of the present invention is installed in a panel member.
Figure 2:
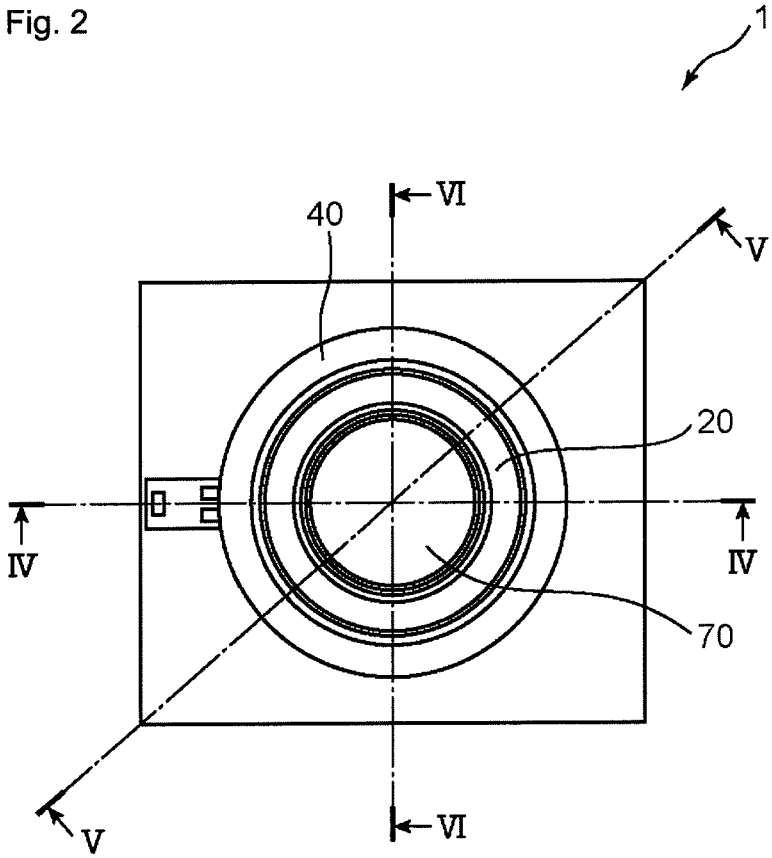
FIG. 2 is a front view of the operating device shown in FIG. 1.
Figure 3:
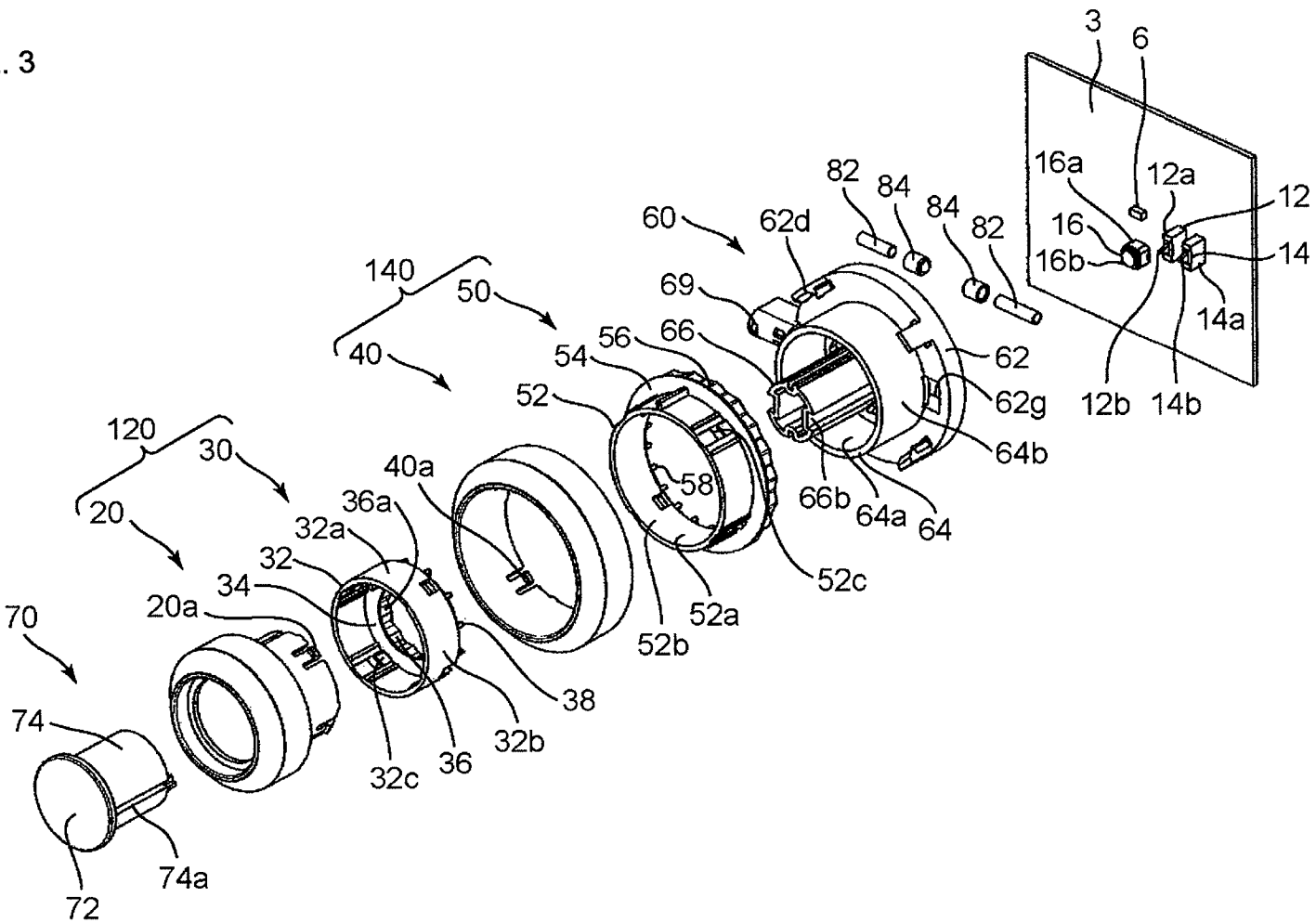
FIG. 3 is a schematic exploded perspective view of the operating device shown in FIG. 1.
Figure 4:
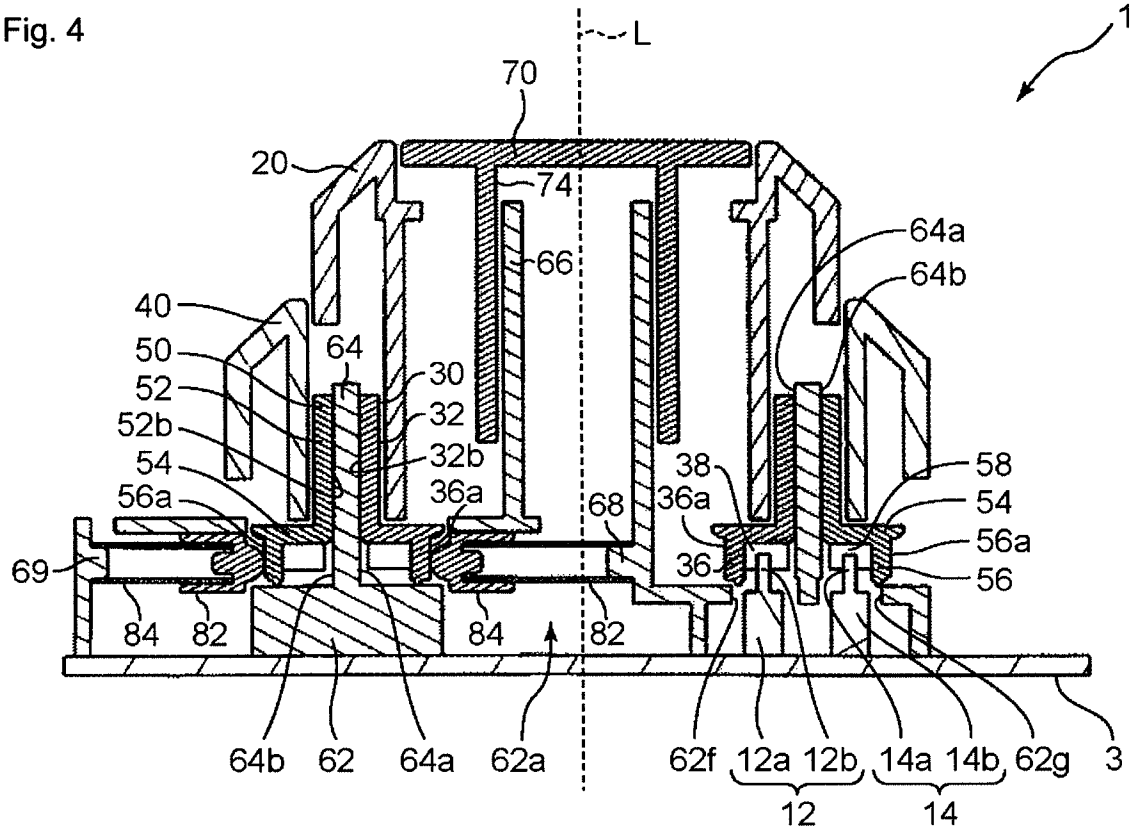
FIG. 4 is a cross-sectional view along a line IV-IV in FIG. 2.
Figure 5:
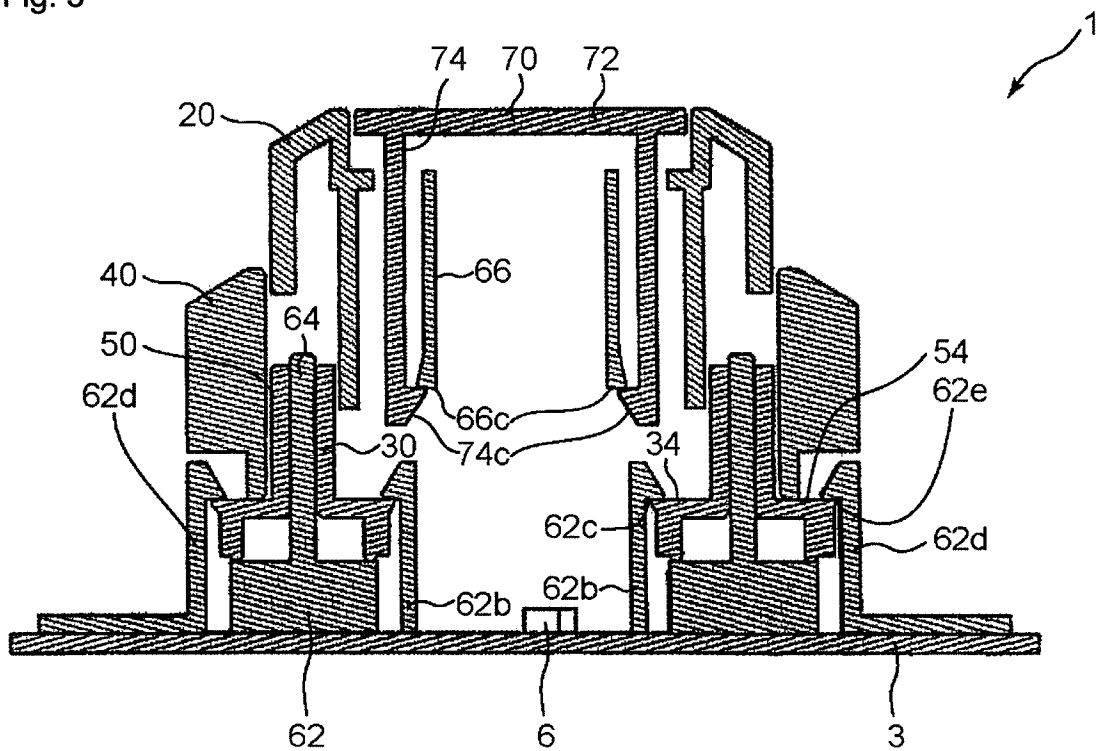
FIG. 5 is a cross-sectional view along a line V-V in FIG. 2.
Figure 6:
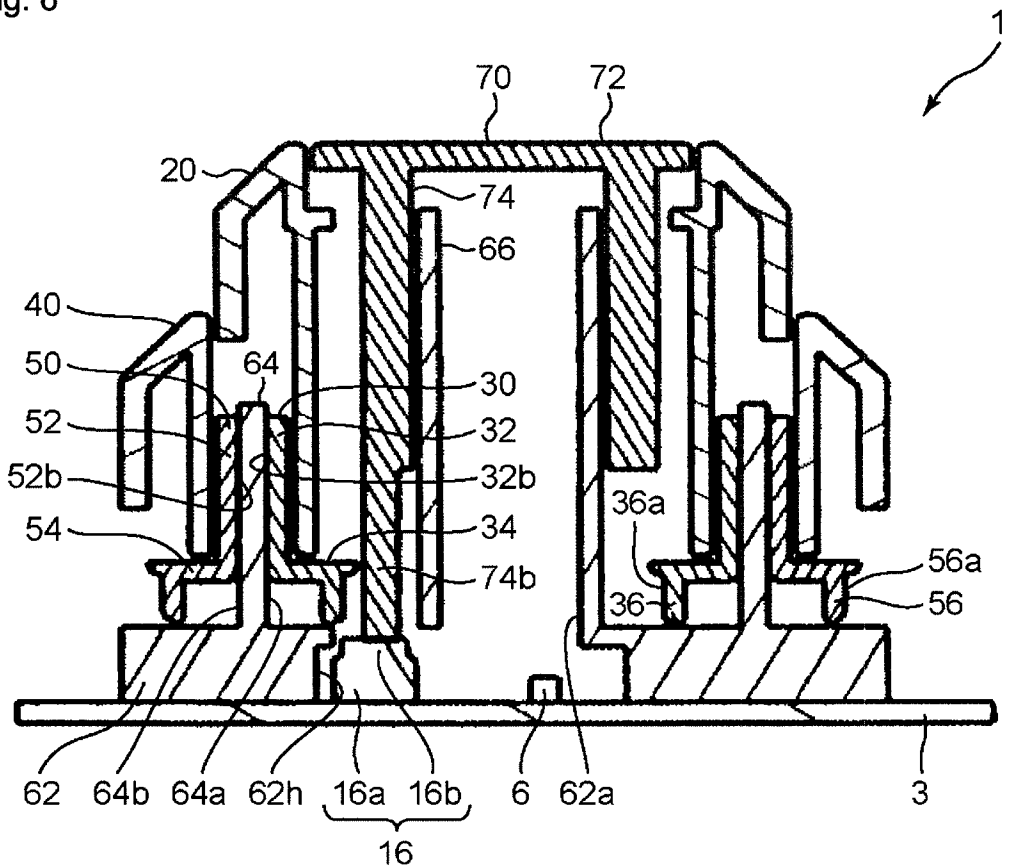
FIG. 6 is a cross-sectional view along a line VI-VI in FIG. 2.

FIG. 1 is a schematic perspective view of a state in which an operating device 1 is installed in a front cover 2. The front cover 2 is fixated to an instrument panel or the like of an automobile. FIG. 2 is a front view of FIG. 1. FIG. 3 is a schematic exploded perspective view of the operating device 1. FIG. 4 is a cross-sectional view along a line IV-IV in FIG. 2. FIG. 5 is a cross-sectional view along a line V-V in FIG. 2. FIG. 6 is a cross-sectional view along a line VI-VI in FIG. 2.

The operating device 1 includes a circuit board 3, an interior rotation operating knob (first rotation operating knob) 120, an exterior rotation operating knob (second rotation operating knob) 140, a holding member 60, a pressure operating knob 70, two springs 82, and two plungers 84 fixated to forefronts of each spring 82. Mounted on the circuit board 3 are an interior switch element (first switch element) 12, an exterior switch element (second switch element) 14, a tact switch element (pressure switch element) 16, and an LED 6. The interior rotation operating knob 120 includes an interior dial (first dial) 20 and an interior holder 30. The exterior rotation operating knob 140 includes an exterior dial (second dial) 40 and an exterior holder 50.

The holding member 60 holds the interior rotation operating knob 120, the exterior rotation operating knob 140, and the pressure operating knob 70. In a state held by the holding member 60, the interior rotation operating knob 120 and the exterior rotation operating knob 140 are able to rotate centered on a shared rotation axis L extending in a front-back direction. In a state held by the holding member 60, the pressure operating knob 70 is capable of sliding displacement along a direction parallel to the rotation axis L. When the interior rotation operating knob 120 receives a rotation operation and rotates, the interior switch element 12 is operated by the interior rotation operating knob 120. When the exterior rotation operating knob 140 receives a rotation operation and rotates, the exterior switch element 14 is operated by the exterior rotation operating knob 140. When the pressure operating knob 70 is pressed and displaces by sliding rearward, the tact switch element 16 is operated by the pressure operating knob 70. In the present embodiment, the rotation axis L extends orthogonally to the circuit board 3.

A configuration of each switch element is described.

The interior switch element 12 includes an interior switch element main body (first switch element main body) 12*a* and an interior detector head (first detector head) 12*b*. The interior switch element main body 12*a* is fixated to the circuit board 3 in a state projecting in an obverse, i.e., forward, direction of the circuit board 3. The interior detector head 12*b* projects further forward from the interior switch element main body 12*a*. When a force is received in a direction parallel to the circuit board 3, the interior detector head 12*b* retreats in a direction parallel to the circuit board 3 from a standing state projecting forward. When the force is removed, the interior detector head 12*b* reverts to the standing state. The interior switch element main body 12*a* outputs a predetermined signal (first detection signal) each time the interior detector head 12*b* retreats.

The exterior switch element 14 has a similar configuration as the interior switch element 12. The exterior switch element 14 includes an exterior switch element main body (second switch element main body) 14*a* and an exterior detector head (second detector head) 14*b*. The exterior switch element 14 is fixated to the circuit board 3 in a state where the exterior switch element main body 14*a* and the exterior detector head 14*b* project in an obverse direction of the circuit board 3. Each time the exterior detector head 14*b* receives a force in a direction parallel to the circuit board 3 and thereby retreats, the exterior switch element main body 14*a* outputs a predetermined signal (second detection signal).

The tact switch element 16 includes a tact switch element main body 16*a* and a tact detector head 16*b*. The tact switch element main body 16*a* is fixated on the circuit board 3 in a state projecting forward. The tact switch detector head 16*b* projects further forward from the tact switch element main body 16*a*. When a force in a direction toward the circuit board 3 is applied to the front edge surface of the tact switch detector head 16*b*, the tact switch detector head 16*b* displaces from a position separated from the circuit board 3 in a direction approaching the circuit board 3. When the force is removed, the tact switch detector head 16*b* reverts to the separated position. Each time the tact switch detector head 16*b* displaces in the direction approaching the circuit board 3, the tact switch element main body 16*a* outputs a predetermined signal (pressure detection signal).

Configurations of the interior dial 20 and the interior holder 30 are described.

As described above, the interior dial 20 and the interior holder 30 configure the interior rotation operating knob 120. The interior rotation operating knob 120 operates the interior switch element 12 by receiving a rotation operation and rotating centered on the rotation axis L.

The interior dial 20 has a substantially circular tubular shape extending in the rotation axis L direction and centered on the rotation axis L. The interior dial 20 has a centrally hollow shape and an interior surface surrounding the rotation axis L. In a state where the operating device 1 is installed in the front cover 2, a front portion of the interior dial 20 projects forward further than the front cover 2 and is exposed to an exterior. A user grips the front portion of the interior dial 20 to rotate the interior dial 20. A latched portion 20*a* which is latched to the interior holder 30 is provided on a rear edge portion of the interior dial 20.

The interior holder 30 has a substantially circular tubular shape extending in the rotation axis L direction and centered on the rotation axis L. The interior holder 30 includes an interior slider 32, an interior flange 34, an interior operational feedback imparter 36, and a plurality of interior switch operating projections (first switch operators) 38.

The interior slider 32 has a substantially circular tubular shape extending in the rotation axis L direction and centered on the rotation axis L. An interior sliding surface (first sliding surface) 32*b* configured with a smooth surface is formed on an outer circumferential surface 32*a* of the interior slider 32 on a portion spanning nearly the entirety thereof. The interior sliding surface 32*b* has a circular columnar surface shape, i.e., a circular tubular shape, centered on the rotation axis L. The interior sliding surface 32*b* is able to slide along an interior support surface (first support surface) 64*a* of the dial holder 64, discussed hereafter, on the holding member 60. The interior support surface 64*a* of the dial holder 64 has a circular columnar surface shape, i.e., a circular tubular shape. A latching portion 32*c* is formed on an inner circumferential surface of the interior slider 32. The latching portion 32*c* latches with the latched portion 20*a* of the interior dial 20. Due to the latching of the latched portion 20*a* and the latching portion 32*c*, the interior holder 30 is rotatably and integrally connected to the interior dial 20. In this connected state, the rear portion of the interior dial 20 is inserted to an interior of the interior slider 32.

The interior flange 34 projects toward the interior, i.e., toward the rotation axis L side, from the rear edge portion of the interior slider 32.

The interior operational feedback imparter 36, along with the spring 82 and the plunger 84, configures an operational feedback imparting mechanism for imparting favorable operational feedback to the user. The interior operational feedback imparter 36 has a substantially circular tubular shape centered on the rotation axis L. The interior operational feedback imparter 36 extends rearward from the rear edge surface of the interior flange 34. Protrusions projecting toward the interior are formed at equal intervals in a circumferential direction on an inner circumferential surface 36*a* of the interior operational feedback imparter 36.

The spring 82 is fixated between an interior spring holder 68 and the inner circumferential surface 36*a* of the interior operational feedback imparter 36 by the interior spring holder 68, described hereafter, of the holding member 60. In this fixated state, the spring 82 is compressed in a direction parallel to the circuit board 3. The plunger 84 is fixated on an end portion on a side opposite to the fixated end of the spring 82. The plunger 84 is pressed against the inner circumferential surface 36*a* of the interior operational feedback imparter 36 by an elastic opposing force of the spring 82. When the interior dial 20 is rotated and the interior holder 30 rotates, the location against which the plunger 84 is pressed changes, between the protrusions described above and portions between the protrusions. As the pressing location changes, the spring 82 extends and contracts in a direction parallel to the circuit board 3. Accompanying the extension and compression of the spring 82, the force applied to the interior holder 30 and the interior dial 20 by the spring 82 changes. This change in force imparts a favorable clicking sensation to the user.

Each time the interior switch operating projections 38 pass a position opposite the interior switch element 12, the interior switch operating projections 38 cause the interior switch element 12 to output a first detection signal. The interior switch operating projections 38 project rearward from a rear edge surface of the interior flange 34. The interior switch operating projections 38 are aligned at equal intervals in the rotation circumference direction centered on the rotation axis L. The interior switch element 12 is positioned on a circumference where the interior switch operating projections 38 are aligned. The interior detector head 12*b* is positioned in an orientation such that the interior detector head 12*b* will retreat along the rotation circumference direction of the interior switch operating projections 38. Each time the interior switch operating projections 38 pass a position opposite the interior switch element 12, the interior switch operating projections 38 contact the interior detector head 12*b* from a lateral direction and cause the interior detector head 12*b* to retreat. In this way, the interior switch element 12 retreats in response to a passage amount of the interior switch operating projections 38, i.e., in response to a rotation amount of the interior holder 30 (in other words, the interior rotation operating knob 120), and outputs a signal corresponding to the rotation amount.

The interior switch element 12 may also output a signal that differs according to a difference in the direction in which the interior detector head 12*b* retreats, i.e., the rotation direction of the interior rotation operating knob 120. A signal may also be output only when the interior switch element 12 retreats in one direction, i.e., only when the interior rotation operating knob 120 is rotated in one direction of either a positive rotation direction or a negative rotation direction.

Configurations of the exterior dial 40 and the exterior holder 50 are described.

The exterior dial 40 and the exterior holder 50, as described above, configure the exterior rotation operating knob 140. When receiving a rotation operation, the exterior rotation operating knob 140 operates the exterior switch element 14 by rotating centered on the rotation axis L.

The exterior dial 40 has a substantially circular tubular shape extending in the rotation axis L direction, axially centered on the rotation axis L. In a state where the operating device 1 is installed in the front cover 2, a front portion of the exterior dial 40 projects forward further than the front cover 2 and is exposed to the exterior. The user grips the front portion of the exterior dial 40 to rotate the exterior dial 40. The exterior dial 40 has a diameter larger than the interior dial 20. The inner diameter of the exterior dial 40 is set to a value capable of accommodating the interior dial 20 therein. A latched portion 40*a* latched to the exterior holder 50 is provided to the rear edge portion of the exterior dial 40.

The exterior holder 50 has a substantially circular tubular shape extending in the rotation axis L direction, axially centered on the rotation axis L. The exterior holder 50 includes an exterior slider 52, an exterior flange 54, an exterior operational feedback imparter 56, and a plurality of exterior switch operating projections (second switch operators) 58.

The exterior slider 52 has a substantially circular tubular shape extending in the rotation axis L direction, axially centered on the rotation axis L. An exterior sliding surface (second sliding surface) 52*b* configured with a smooth surface is formed on an inner circumferential surface 52*a* of the exterior slider 52 on a portion spanning nearly the entirety thereof. The exterior sliding surface 52*b* has a circular columnar surface shape, i.e., a circular tubular shape, centered on the rotation axis L. The exterior sliding surface 52*b* is able to slide along an exterior support surface (second support surface) 64*b* of the dial holder 64, described hereafter, on the holding member 60. The exterior support surface 64*b* of the dial holder 64 has a circular columnar surface shape, i.e., a circular tubular shape. A latching portion 52*c* is formed on an outer circumferential surface of the exterior slider 52. The latching portion 52*c* latches with the latched portion 40*a* on the exterior dial 40. Due to the latching of the latched portion 40*a* and the latching portion 52*c*, the exterior holder 50 is rotatably and integrally connected to the exterior dial 40. In this connected state, the exterior slider 52 is inserted to an interior of a rear portion of the exterior dial 40.

The exterior flange 54 projects diametrically outward from the rear edge portion of the exterior slider 52.

Similar to the interior operational feedback imparter 36, the exterior operational feedback imparter 56, along with the spring 82 and the plunger 84, configures an operational feedback imparting mechanism for imparting favorable operational feedback to the user. The exterior operational feedback imparter 56 has a substantially circular tubular shape centered on the rotation axis L. The exterior operational feedback imparter 56 extends rearward from the rear edge surface of the exterior flange 54. Protrusions projecting toward the exterior are formed at equal intervals in a circumferential direction on an outer circumferential surface 56*a* of the exterior operational feedback imparter 56.

The spring 82 is fixated between an exterior spring holder 69 and the outer circumferential surface 56*a* of the exterior operational feedback imparter 56 by the exterior spring holder 69, described hereafter, on the holding member 60. In this fixated state, the spring 82 is compressed in a direction parallel to the circuit board 3. The plunger 84 is fixated to an end portion on a side opposite to the fixated end of the spring 82. The plunger 84 is pressed against the outer circumferential surface 56*a* of the exterior operational feedback imparter 56 by the elastic opposing force of the spring 82. When the exterior dial 40 is rotated and the exterior holder 50 rotates, the location against which the plunger 84 is pressed changes, between the protrusions described above and portions between the protrusions. As the pressing location changes, the spring 82 extends and contracts in a direction parallel to the circuit board 3. Accompanying this extension and compression of the spring 82, the force applied to the exterior holder 50 and the exterior dial 40 by the spring 82 changes. This change in force imparts a favorable clicking sensation to the user.

Each time the exterior switch operating projections 58 pass a position opposite the exterior switch element 14, the exterior switch operating projections 58 cause the exterior switch element 14 to output a second detection signal. The exterior switch operating projections 58 project rearward from the rear edge surface of the exterior flange 54. The exterior switch operating projections 58 are aligned at equal intervals in the rotation circumference direction centered on the rotation axis L. The exterior switch element 14 is positioned on the circumference where the exterior switch operating projections 58 are aligned. The exterior detector head 14*b* is positioned in an orientation such that the exterior detector head 14*b* will retreat back along the rotation circumference direction of the exterior switch operating projections 58. Each time the exterior switch operating projections 58 pass a position opposite the exterior switch element 14, the exterior switch operating projections 58 contact the exterior detector head 14*b* from a lateral direction and cause the exterior detector head 14*b* to retreat. In this way, the exterior switch element 14 retreats in response to a passage amount of the exterior switch operating projections 58, i.e., in response to a rotation amount of the interior holder 50 (in other words, the exterior rotation operating knob 140), and outputs a signal corresponding to the rotation amount.

Moreover, similar to the interior switch element 12, the exterior switch element 14 may also output a signal that differs according to a difference in the direction in which the exterior detector head 14*b* retreats, i.e., the rotation direction of the exterior rotation operating knob 140. The exterior switch element 14 may also output a signal only when retreating in one direction, i.e., only when the exterior rotation operating knob 140 is rotated in one direction of either the positive rotation direction or the negative rotation direction.

A specific configuration of the pressure operating knob 70 is described.

As described above, the pressure operating knob 70 receives a pressure operation and displaces by sliding rearward to operate the tact switch 16.

The pressure operating knob 70 includes a button 72 and a button support 74. The button 72 has a circular plate shape centered on the rotation axis L. The button support 74 has a substantially circular tubular shape extending rearward form a rear surface of the button 72. An outer diameter of the pressure operating knob 70 is set smaller than an inner diameter of the interior dial 20. The pressure operating knob 70 is positioned within a space bounded by the interior surface of the interior dial 20. In this disposed state, a central axis of the button support 74 coincides with the rotation axis L.

The user can press the button 72. The button 72 is disposed in a position covering the bounded space at a front end of the interior surface of the interior dial 20, and is exposed forward.

The outer circumferential surface of the button support 74 is provided with a slider 74*a*. The slider 74*a* projects diametrically outward from the outer circumferential surface of the button support 74 and extends in the rotation axis L direction. The slider 74*a* is positioned within a guide groove 66*b* of a pressure operating knob holder 66, described hereafter, on the holding member 60. In this disposed state, the slider 74*a* is able to slide in a front-back direction along the guide groove 66*b*. As the slider 74*a* moves along the guide groove 66*b*, the pressure operating knob 70 is able to be displaced by sliding in a front-back direction, i.e., a direction making contact with and separating from the circuit board 3.

A tact switch operator 74*b* is provided on one portion of a rear edge of the button support 74. The tact switch operator 74*b* extends rearward from the rear edge of the button support 74. The tact switch operator 74*b* transfers to the tact switch 16 a pressure force applied to the button 72 by the user, thus pressing the tact switch 16. The tact switch 16 is disposed to the rear of the tact switch operator 74*b*. The rear edge surface of the tact switch operator 74*b* and the front edge surface of the tact switch detector head 16*b* are in contact. When the button 72 is pressed, the button support 74 moves by sliding rearward along with the button 72. The tact switch operator 74*b* moves rearward accompanying the rearward sliding movement of the button 72 and presses the tact switch detector head 16*b* rearward.

A latched projection 74*c* is provided on the rear edge of the button support 74. The latched projection 74*c* projects toward the rotation axis L side from the button support 74.

A specific configuration of the holding member 60 is described.

The holding member 60 includes a base 62, the dial holder (rotation operating knob holder) 64, the pressure operating knob holder 66, the interior spring holder 68, and the exterior spring holder 69.

The base 62 has a substantially circular tubular shape in substantially a center of which a through-hole 62*a* is formed. The base 62 is fixated to the circuit board 3. In this fixated state, the rotation axis L runs through substantially a center of the through-hole 62*a*.

The dial holder 64 is for holding the interior holder 30 and the exterior holder 50. The dial holder 64 is interposed between the interior holder 30 and the exterior holder 50. The dial holder 64 projects forward from the front edge surface of the base 62 at a position further diametrically inward than the outer circumferential edge of the base 62. The dial holder 64 has a circular tubular shape centered on the rotation axis L. An inner circumferential surface 64*a* of the dial holder 64 configures the interior support surface 64*a* having a circular tubular shape and centered on the rotation axis L. An outer circumferential surface 64*b* of the dial holder 64 configures the exterior support surface 64*b* having a circular tubular shape and centered on the rotation axis L. The exterior support surface 64*b* has a diameter larger than the interior support surface 64*a*.

The interior holder 30 is accommodated on an interior of the dial holder 64. In this accommodated state, the interior sliding surface 32*b* of the interior holder 30 contacts the interior support surface 64*a* of the dial holder 64. The interior sliding surface 32*b* slides along the interior support surface 64*a* accompanying rotation of the interior holder 30. The contact between the interior sliding surface 32*b* and the interior support surface 64*a* regulates movement of the interior holder 30 in the diameter direction. Herein, as described above, the interior support surface 64*a* of the dial holder 64 has a circular tubular shape centered on the rotation axis L. In addition, in a state where the interior sliding surface 32*b* and the interior support surface 64*a* are in contact, the interior holder 30 is accommodated on an interior of the dial holder 64. Therefore, the dial holder 64 holds the interior dial 20 and the interior sliding surface 32*b* (i.e., the interior holder 30), which is in contact with the interior support surface 64*a*, in a position where a central axis of each is the rotation axis L.

The exterior holder 50 is positioned on an exterior of the dial holder 64. In this disposed state, the dial holder 64 and the interior holder 30 are accommodated on an interior of the exterior holder 50. Also, in this disposed state, the exterior sliding surface 52*b* of the exterior holder 50 and the exterior support surface 64*b* of the dial holder 64 are in contact. For the exterior sliding surface 52*b*, the contact between the exterior support surface 64*b* and the exterior sliding surface 52*b*, which slides along the exterior support surface 64*b* accompanying rotation of the exterior holder 50, regulates movement of the exterior holder 50 in the diameter direction. Herein, as described above, the exterior support surface 64*b* of the dial holder 64 has a circular tubular shape centered on the rotation axis L. In addition, in a state where the exterior sliding surface 52*b* and the exterior support surface 64*b* are in contact, the exterior holder 50 is disposed on an interior of the dial holder 64. Therefore, the dial holder 64 holds the exterior dial 40 and the exterior sliding surface 52*b* (i.e., the exterior holder 50), which is in contact with the exterior support surface 64*b*, in a position where a central axis of each is the rotation axis L.

In a held-and-connected state where the exterior holder 50 and the interior holder 30 are held by the dial holder 64 and where the exterior holder 50 and the interior holder 30 are respectively connected to the exterior dial 40 and the interior dial 20, the interior dial 20 is positioned on an interior of the exterior dial 40 and projects further forward than the exterior dial 40. That is, in the held-and-connected state, the length of the exterior dial 40 and the exterior holder 50 in the front-back direction is set to a size where the front edges of the exterior dial 40 and the exterior holder 50 are positioned further rearward than the front edge of the interior dial 20. In this way, in the present operating device 1, the positions of the exterior dial 40 and the interior dial 20 in the diameter direction and the front-back direction differ. Thus, a situation where the user mistakes the dials 20 and 40 for the other when operating is avoided.

Interior latching portions 62*b* are provided on the base 62 at portions further diametrically inward than the dial holder 64. In the present embodiment, a plurality of interior latching portions 62*b* are provided. The interior latching portions 62*b* project forward from the front edge surface of the base 62. The interior latching portions 62*b* are separated from one another in the circumferential direction. A latching surface 62*c* extending parallel to the circuit board 3 is formed on each of the interior latching portions 62*b*. The latching surfaces 62*c* project diametrically outward from the interior latching portions 62*b* in positions separated further forward than the front edge surface of the base 62. The latching surfaces 62*c* contact the front edge surface of the interior flange 34 of the interior holder 30 from the front. This contact regulates forward escape of the interior holder 30.

An exterior latching portion 62*d* is provided at a portion further diametrically exterior than the dial holder 64 on the outer circumferential end of the base 62, i.e., on the base 62. In the present embodiment, a plurality of exterior latching portions 62*d* are provided. The exterior latching portions 62*d* project forward from the front edge surface of the base 62. The exterior latching portions 62*d* are separated from one another in the circumferential direction. A latching surface 62*e* extending parallel to the circuit board 3 is formed on each of the exterior latching portions 62*d*. The latching surfaces 62*e* project diametrically inward from the exterior latching portions 62*d* in positions separated further forward than the front edge surface of the base 62. The latching surfaces 62*e* contact the front edge surface of the exterior flange 54 of the exterior holder 30 from the front. This contact regulates forward escape of the exterior holder 50.

An interior switch element through-hole 62*f* running through the base 62 in the front-back direction is formed on the base 62. The interior switch element through-hole 62*f* is formed on the base 62 further diametrically inward than the interior support surface 64*a* and at a portion where the interior switch operating projections 38 pass. The interior switch element 12 is positioned within the interior switch element through-hole 62*f*. In this disposed state, the interior detector head 12*b* projects further forward than the front edge surface of the base 62 and, moreover, further forward than the rear edge of the interior switch operating projections 38 passing in front of the front edge surface. In this disposed state, the interior detector head 12*b* is able to contact the interior switch operating projections 38. In addition, in this disposed state, as described above, the interior detector head 12*b* has an orientation such that the interior detector head 12*b* will retreat along the circumferential direction centered on the rotation axis L.

An exterior switch element through-hole 62*g* running through the base 62 in the front-back direction is formed on the base 62. The exterior switch element through-hole 62*g* is formed on the base 62 further diametrically outward than the exterior support surface 64*b* and at a portion where the exterior switch operating projections 58 pass. The exterior switch element 14 is positioned within the exterior switch element through-hole 62*g*. In this disposed state, the exterior detector head 14*b* projects further forward than the front edge surface of the base 62 and, moreover, further forward than the rear edge of the exterior switch operating projections 58 passing in front of the front edge surface. In this disposed state, the exterior detector head 14*b* is able to contact the exterior switch operating projections 58. In addition, in this disposed state, as described above, the exterior detector head 14*b* has an orientation such that the exterior detector head 14*b* will retreat along the circumferential direction centered on the rotation axis L.

In the present embodiment, the interior switch element through-hole 62*f* and the exterior switch element through-hole 62*g* are aligned in the diameter direction. The interior switch element 12 and the exterior switch element 14 are aligned in the diameter direction.

The pressure operating knob holder 66 holds the pressure operating knob 70. The pressure operating knob holder 66 projects forward from the inner circumferential end of the base 62. The pressure operating knob holder 66 has a tubular shape surrounding the rotation axis L. The pressure operating knob holder 66 is positioned further inward than the dial holder 64. The guide groove 66*b* is formed on the outer circumferential surface of the pressure operating knob holder 66. The guide groove 66*b* extends in a direction parallel to the rotation axis L. As described above, the guide groove 66*b* guides the slider 74*a* of the button support 74 (i.e., the pressure operating knob 70) in the front-back direction.

A latching portion 66*c* is provided on the outer circumferential surface of the pressure operating knob holder 66. The latching portion 66*c* latches with the latched projection 74*c* of the pressure operating knob 70. With this latching, the pressure operating knob 70 is held by the pressure operating knob holder 66 so as to be capable of sliding displacement in the front-back direction. Specifically, the latching portion 66*c* contacts the latched projection 74*c* of the pressure operating knob 70 from the front, and thus regulates forward escape of the pressure operating knob 70. In this held state, the front portion of the pressure operating knob holder 66 is inserted into the diametrical interior of the button support 74 of the pressure operating knob 70.

A tact switch through-hole 62*h* running through the base 62 in the front-back direction is formed on the base 62. The tact switch through-hole 62*h* is formed further diametrically outward than the pressure operating knob holder 66 and in a position opposite the tact switch operator 74*b* of the pressure operating knob 70. The tact switch element 16 is positioned within the tact switch through-hole 62*h*. In this disposed state, the front edge surface of the tact switch element 16 is exposed forward to make contact with the rear edge surface of the tact switch operator 74*b*.

The LED 6 is positioned on a portion adjacent to the rotation axis L on a region bounded by the interior surface of the pressure operating knob holder 66. Light given off by the LED 6 passes through the space bounded by the interior surface of the pressure operating knob holder 66, reaches the button 72 of the pressure operating knob 70, and illuminates the button 72.

The interior spring holder 68 and the exterior spring holder 69 each hold a respective plunger 84 and spring 82.

The interior spring holder 68 projects diametrically inward from the interior surface of the knob holder 66. The interior spring holder 68 extends parallel to the circuit board 3. The interior spring holder 68 holds a base end of the spring 82. In the held state, the spring 82 is positioned further diametrically inward than the dial holder 64. In addition, the plunger 84 which is fixated to a foremost end of the spring 82 faces the dial holder 64. Moreover, the spring 82 is elastically deformed in a direction parallel to the circuit board 3.

The exterior spring holder 69 is positioned further diametrically outward than the base 62. The exterior spring holder 69 projects forward from the circuit board 3. The exterior spring holder 69 holds the base end of the spring 82. In this held state, the spring 82 is positioned further diametrically outward than the dial holder 64. In addition, the plunger 84 which is fixated to the foremost end of the spring 82 faces the dial holder 64. Moreover, the spring 82 is elastically deformed in a direction parallel to the circuit board 3.

As above, in the present operating device 1, the dial holder 64 of the holding member 60 holds the interior holder 30 (i.e., the interior rotation operating knob 120) that operates the interior switch element 12 and the exterior holder 50 (i.e., the exterior rotation operating knob 140) that operates the exterior switch element 14 such that each is capable of mutually independent rotation around the shared rotation axis L. Therefore, compared to a case where independent holding members hold the rotation operating knobs 120 and 140 around different rotation axes, the number of holding members is reduced and the space required for the operating device is kept small.

Moreover, the interior holder 30 and the exterior holder 50 are positioned so as to slide along the interior support surface 64*a*, which is configured by the outer circumferential surface of the dial holder 64, and the exterior support surface 64*b*, which is configured by the inner circumferential surface of the dial holder 64. In addition, with the shared dial holder 64, each diametrical direction position of the interior holder 30 and the exterior holder 50 are set. Therefore, positioning drift in a diametrical direction of the interior holder 30 and the exterior holder 50 (i.e., positioning drift in a diametrical direction of the interior dial 20 and the exterior dial 40) is kept small and there is an increased capacity for design.

Herein, the interior switch element 12 and the exterior switch element 14 may output a signal each time the interior switch operating projections 38 and the exterior switch operating projections 58 pass the positions opposite thereto. However, the specific configuration thereof is not limited to the above. For example, a non-contact type switch element is acceptable.

In addition, even in a case where, for each of the switch elements 12 and 14, the type that is used outputs a signal due to the detector heads 12*b* and 14*b* thereof retreating in a predetermined position, the placement of the switch elements 12 and 14 is not limited to the above. For example, each of the switch elements 12 and 14 may be positioned either diametrically interior or exterior to the respective switch operating projections 38 and 58. In addition, each of the detector heads 12*b* and 14*b* may project in a direction perpendicular to the rotation axis L. However, in this embodiment, when each of the switch elements 12 and 14 is positioned to the rear of the respective switch operating projections 38 and 58, and also each of the detector heads 12*b* and 14*b* retreat in a rotation circumference direction of the switch operating projections 38 and 58, the space required for positioning the switch elements 12 and 14 on a surface orthogonal to the rotation axis L is kept small.

In addition, the tact switch element 16 and the pressure operating knob 70, in which the tact switch element 16 can be pressed, can be omitted. However, in a case where the pressure operating knob holder 66 is provided to the holding member 60 and the pressure operating knob holder 66 holds the pressure operating knob 70 in a state positioned within a space bounded by the interior surface of the interior dial 20, the space required for the operating device 1 does not greatly increase and operation of the pressure operating knob 70, along with the interior rotation operating knob 120 and the exterior rotation operating knob 140, is enabled.

In addition, the slider 74*a* of the pressure operating knob 70 and the guide groove 66*b* of the pressure operating knob holder 66 can be omitted. However, in a case where they are provided and the pressure operating knob holder 66 holds the pressure operating knob 70 so as to be capable of sliding in the front-back direction, the pressure force from the pressure operating knob 70 is stabilized and is transmitted to the tact switch element 16. This improves operability.

As above, the present invention provides an operating device that includes a first rotation operating knob rotated so as to rotate centered on a rotation axis extending in a front-back direction; a second rotation operating knob positioned exterior in a rotation diameter direction of the first rotation operating knob and rotated so as to rotate centered on the rotation axis shared with the rotation axis of the first rotation operating knob; a holding member interposed between the first rotation operating knob and the second rotation operating knob and including a tubular rotation operating knob holder that holds the first rotation operating knob and the second rotation operating knob such that both are capable of mutually independent rotation; a first switch element outputting a signal corresponding to a rotation amount of the first rotation operating knob; and a second switch element outputting a signal corresponding to the rotation amount of the second rotation operating knob. The rotation operating knob holder includes an inner circumferential surface including a first support surface having a substantially circular tubular shape centered on the rotation axis and an outer circumferential surface including a second support surface having a substantially circular tubular shape centered on the rotation axis and having a diameter greater than the first support surface. The first rotation operating knob includes first switch operators provided in a plurality of positions aligned in a rotation circumference direction thereof and causing the first switch element to output a first detection signal each time one of the first switch operators passes a position opposite the first switch element, and an outer circumferential surface including a first sliding surface having a substantially circular tubular shape capable of sliding in the rotation circumference direction over the first support surface. The second rotation operating knob includes second switch operators provided in a plurality of positions aligned in a rotation circumference direction thereof and causing the second switch element to output a second detection signal each time one of the second switch operators passes a position opposite the second switch element, and an inner circumferential surface including a second sliding surface having a substantially circular tubular shape capable of sliding in the rotation circumference direction over the second support surface.

In the operating device, the holding member holds the first rotation operating knob, which has the first switch operator causing the first switch element to output the signal, and the second rotation operating knob, which has the second switch operator causing the second switch element to output the signal, so as to be capable of mutually independent rotation centered on the shared rotation axis. Thus, the two rotation operating knobs (i.e., the two switch elements) are capable of mutually independent operation and, compared to a case in which the rotation operating knobs are held around individual rotation axes by individual holding members, the number of holding members decreases, and the space required in a direction perpendicular to the rotation axis is kept small.

Moreover, in the operating device, the rotation operating knob holder holds the first rotation operating knob and the second rotation operating knob such that the first sliding surface of the first rotation operating knob slides along the first support surface included in the outer circumferential surface thereof and such that the second sliding surface of the second rotation operating knob slides along the second support surface included in the inner circumferential surface thereof to determine a position in a rotation diameter direction of the second rotation operating knob, in addition to the first rotation operating knob. Therefore, positioning drift in the rotation diameter direction between the rotation operating knobs (i.e., positioning drift of the rotation axes between the rotation operating knobs) is kept small. This increases the capacity for design in the operating device.

In the present invention, a circuit board is further provided positioned to the rear of the first rotation operating knob and the second rotation operating knob. The holding member is fixated on the circuit board and, in addition, the first switch element is mounted on a portion further inward on the circuit board than the first support surface of the rotation operating knob holder and the second switch element is mounted on a portion further outward on the circuit board than the second support surface of the rotation operating knob holder.

According to this configuration, the shared rotation operating knob holder holds the first rotation operating knob and the second rotation operating knob on the interior and exterior of the rotation operating knob holder, respectively. In addition, the first switch element and the second switch element, which are each mounted on portions on the shared circuit board interior and exterior to the rotation operating knob, respectively, can detect the rotation amount of the respective rotation operating knob. With this configuration, the holding member holding the first rotation operating knob and the second rotation operating knob is fixated on the circuit board, to which the first switch element and the second switch element are mounted. Therefore, the positioning drift of each rotation operating knob with respect to each switch element is kept small.

In such a case, an example is given in which the first switch element includes a first detector head, which is positioned to the rear of the first switch operators and which is operated in the rotation circumference direction of the first rotation operating knob by the first switch operators each time one of the first switch operators passes accompanying rotation of the first rotation operating knob, and a first switch element main body outputting the first detection signal each time the first detector head is operated. In addition, an example is given in which the second switch element includes a second detector head, which is positioned to the rear of the second switch operators and which is operated in the rotation circumference direction of the second rotation operating knob by the second switch operators each time one of the second switch operators passes accompanying rotation of the second rotation operating knob, and a second switch element main body outputting the second detection signal each time the second detector head is operated.

The present invention preferably includes the pressure operating knob, which receives a pressure operation in an orientation approaching the circuit board so as to be displaced in an orientation approaching the circuit board along a direction parallel to the rotation axis, and the pressure switch element, which is mounted on the circuit board and which outputs a pressure detection signal by receiving a pressure force from the pressure operating knob which has received a pressure operation and been displaced. The first rotation operating knob preferably has a centrally hollow shape having an interior surface surrounding the rotation axis, and the pressure operating knob is preferably held by the holding member in a state positioned within a space bounded by the interior surface of the first rotation operating knob.

With this configuration, the holding member holds the pressure operating knob in addition to the first rotation operating knob and the second rotation operating knob. Therefore, compared to a case where the holding member for holding the pressure operating knob is separately provided, the number of components can be kept small. Moreover, operation of the pressure operating knob, i.e., the pressure switch element, in addition to the first rotation operating knob and the second rotation operating knob, i.e., the first switch element and the second switch element, is enabled. In particular, the pressure operating knob is positioned within the space bounded by the interior surface of the first rotation operating knob. Therefore, the pressure operating knob can be provided while inhibiting an increase in size for the entire device.

In such a case, in addition to the rotation operating knob holder, the holding member preferably includes the pressure operating knob holder which is positioned on an interior of the rotation operating knob holder and holds the pressure operating knob so as to be capable of sliding in a pressing direction thereof.

According to this configuration, the pressure force from the pressure operating knob is transmitted more stably to the pressure switch element. This increases operability.

In the present invention, the first rotation operating knob preferably includes a first dial capable of being gripped for rotation, the second rotation operating knob preferably includes a second dial having a substantially circular tubular shape positioned further outward than the first dial and capable of being gripped for rotation, and the first dial is preferably positioned further forward than the second dial in a direction along the rotation axis.

With this configuration, the position of the first dial in the rotation axis direction and the position of the second dial in the rotation axis direction differ from each other. Therefore, the first dial and the second dial are inhibited from being mistaken for the other when gripped. This increases operability of the operating device.

The invention claimed is:

1. An operating device, comprising:

a first rotation operating knob which is rotated centered on a rotation axis extending in a front-back direction, a second rotation operating knob which is positioned on an exterior side in a rotation diameter direction of the first rotation operating knob and which is rotated centered on the rotation axis shared with the first rotation operating knob, a holding member which is interposed between the first rotation operating knob and the second rotation operating knob and which includes a tubular rotation operating knob holder holding the first rotation operating knob and the second rotation operating knob such that both are capable of mutually independent rotation, a first switch element which outputs a signal corresponding to a rotation amount of the first rotation operating knob, and a second switch element which outputs a signal corresponding to a rotation amount of the second rotation operating knob, wherein the rotation operating knob holder comprises:

an inner circumferential surface including a first support surface having a substantially circular tubular shape centered on the rotation axis, and an outer circumferential surface including a second support surface having a diameter larger than the first support surface and having a substantially circular tubular shape centered on the rotation axis;

the first rotation operating knob comprises:

first switch operators provided at a plurality of positions aligned in a rotation circumference direction of the first rotation operating knob and causing the first switch element to output a first detection signal each time one of the first switch operators passes a position opposite the first switch element, and an outer circumferential surface including a first sliding surface having a substantially circular tubular shape and capable of sliding over the first support surface in the rotation circumference direction; and the second rotation operating knob comprises:

second switch operators provided at a plurality of positions aligned in the rotation circumference direction of the second rotation operating knob and causing the second switch element to output a second detection signal each time one of the second switch operators passes a position opposite the second switch element, and an inner circumferential surface including a second sliding surface having a substantially circular tubular shape and capable of sliding over the second support surface in the rotation circumference direction.

2. The operating device according to claim 1, wherein the operating device further comprises a circuit board positioned to the rear of the first rotation operating knob and the second rotation operating knob, wherein the holding member is fixated on the circuit board, the first switch element is mounted on a portion further inward on the circuit board than the first support surface of the rotation operating knob holder, and the second switch element is mounted on a portion further outward on the circuit board than the second support surface of the rotation operating knob holder.

3. The operating device according to claim 2, wherein the first switch element comprises:

a first detector head, which is positioned to the rear of the first switch operators and which is operated in the rotation circumference direction of the first rotation operating knob by the first switch operators each time one of the first switch operators passes during rotation of the first rotation operating knob; and a first switch element main body outputting the first detection signal each time the first detector head is operated; and the second switch element comprises:

a second detector head, which is positioned to the rear of the second switch operators and which is operated in the rotation circumference direction of the second rotation operating knob by the second switch operators each time one of the second switch operators passes during rotation of the second rotation operating knob; and a second switch element main body outputting the second detection signal each time the second detector head is operated.

4. The operating device according to claim 2, further comprising:

a pressure operating knob, which receives a pressure operation in an orientation approaching the circuit board so as to be displaced in an orientation approaching the circuit board along a direction parallel to the rotation axis; and a pressure switch element, which is mounted on the circuit board and which outputs a pressure detection signal by receiving a pressure force from the pressure operating knob which has received a pressure operation and been displaced, wherein the first rotation operating knob has a centrally hollow shape having an interior surface surrounding the rotation axis, and the pressure operating knob is held by the holding member in a state positioned within a space bounded by the interior surface of the first rotation operating knob.

5. The operating device according to claim 4, wherein the holding member further comprises, a pressure operating knob holder which is positioned on an interior of the rotation operating knob holder and holds the pressure operating knob so as to be capable of sliding in a pressing direction of the pressure operating knob.

6. The operating device according to claim 1, wherein the first rotation operating knob includes a first dial capable of being gripped for rotation, the second rotation operating knob includes a second dial having a substantially circular tubular shape positioned further outward than the first dial and capable of being gripped for rotation, and the first dial is positioned further forward than the second dial in a direction along the rotation axis.

7. The operating device according to claim 3, further comprising:

a pressure operating knob, which receives a pressure operation in an orientation approaching the circuit board so as to be displaced in an orientation approaching the circuit board along a direction parallel to the rotation axis; and a pressure switch element, which is mounted on the circuit board and which outputs a pressure detection signal by receiving a pressure force from the pressure operating knob which has received a pressure operation and been displaced, wherein the first rotation operating knob has a centrally hollow shape having an interior surface surrounding the rotation axis, and the pressure operating knob is held by the holding member positioned within a space bounded by the interior surface of the first rotation operating knob.

8. The operating device according to claim 7, wherein the holding member further comprises, a pressure operating knob holder which is positioned on an interior of the rotation operating knob holder and holds the pressure operating knob so as to be capable of sliding in a pressing direction of the pressure operating knob.

9. The operating device according to claim 2, wherein the first rotation operating knob includes a first dial capable of being gripped for rotation, the second rotation operating knob includes a second dial having a substantially circular tubular shape positioned further outward than the first dial and capable of being gripped for rotation, and the first dial is positioned further forward than the second dial in a direction along the rotation axis.

10. The operating device according to claim 3, wherein the first rotation operating knob includes a first dial capable of being gripped for rotation, the second rotation operating knob includes a second dial having a substantially circular tubular shape positioned further outward than the first dial and capable of being gripped for rotation, and the first dial is positioned further forward than the second dial in a direction along the rotation axis.

11. The operating device according to claim 4, wherein the first rotation operating knob includes a first dial capable of being gripped for rotation, the second rotation operating knob includes a second dial having a substantially circular tubular shape positioned further outward than the first dial and capable of being gripped for rotation, and the first dial is positioned further forward than the second dial in a direction along the rotation axis.

12. The operating device according to claim 5, wherein the first rotation operating knob includes a first dial capable of being gripped for rotation, the second rotation operating knob includes a second dial having a substantially circular tubular shape positioned further outward than the first dial and capable of being gripped for rotation, and the first dial is positioned further forward than the second dial in a direction along the rotation axis.

13. The operating device according to claim 7, wherein the first rotation operating knob includes a first dial capable of being gripped for rotation, the second rotation operating knob includes a second dial having a substantially circular tubular shape positioned further outward than the first dial and capable of being gripped for rotation, and the first dial is positioned further forward than the second dial in a direction along the rotation axis.

14. The operating device according to claim 8, wherein the first rotation operating knob includes a first dial capable of being gripped for rotation, the second rotation operating knob includes a second dial having a substantially circular tubular shape positioned further outward than the first dial and capable of being gripped for rotation, and the first dial is positioned further forward than the second dial in a direction along the rotation axis.

* * * * *